United States Patent [19]

Berendt

[11] Patent Number: 4,903,757

[45] Date of Patent: Feb. 27, 1990

[54] HEAT EXCHANGER ROTOR AND A METHOD OF MANUFACTURING SUCH A ROTOR

[75] Inventor: Thomas Berendt, Waldenburg, Fed. Rep. of Germany

[73] Assignee: Masco GmbH, Sandhausen, Fed. Rep. of Germany

[21] Appl. No.: 199,569

[22] Filed: May 27, 1988

[30] Foreign Application Priority Data

May 30, 1987 [DE] Fed. Rep. of Germany ..... 3718264

[51] Int. Cl.[4] ..... F28D 19/00

[52] U.S. Cl. ..... 165/8; 165/10; 29/890.034

[58] Field of Search ..... 165/8, 10

[56] References Cited

U.S. PATENT DOCUMENTS 4,513,807 4/1985 Rose et al. ..... 165/8

4,546,817 10/1985 Wieland ..... 165/8

*Primary Examiner*—Albert W. Davis, Jr.

*Attorney, Agent, or Firm*—Steven L. Permut; Malcolm L. Sutherland

[57] ABSTRACT

The invention provides a regenerative heat exchanger rotor with an outer casing which comprises a plurality of layers of a helically wound strip orientated so that its width direction is radial with respect to the rotor, a core on which the strip is wound and which is permeable for the medium with which the rotor is to be used, said strip having channels therein to allow the radial passage of the current of the medium. A further strip on the rotor is free of channels and is also wound on the permeable core helically so as to be associated with the channeled strip so that the layers or turns of the unchanneled strip (20) alternate with those of the channeled one with each layer or turn of the channeled strip being followed by one layer or turn of the unchanneled one. This arrangement makes possible an extraordinarily satisfactory efficiency as regards flow and heat transfer. This advantage is combined with the advantage of the possibility of very simple and cost-effective production.

7 Claims, 4 Drawing Sheets

HEAT EXCHANGER ROTOR AND A METHOD OF MANUFACTURING SUCH A ROTOR

BACKGROUND OF THE INVENTION

The present invention relates to hollow cylindrical rotors for regenerative heat exchangers and more particularly to such a rotor comprising an outer casing which comprises a plurality of layers of a helically wound strip orientated so that its width direction is radial with respect to the rotor, a core on which the strip is wound and which is permeable for the medium with which the rotor is to be used, said strip having channels therein to allow the radial passage of the current of the medium.

Such a rotor has been proposed in the German Pat. No. 3,308,445 with the aim of providing a heat exchanger which on the one hand had a high flow and thermal efficiency and on the other hand was able to be simply produced. In order to achieve this object the strip was so designed that the recesses or grooves therein only extended over a fraction of its height and formed the channels in the individual layers of the strip, which were placed in sealing contact with each other so that flow in the circumferential direction was prevented. For shaping the strip while being wound on a drum it was run between embossing rolls with complementary outer faces, the shaped or embossed strip then being continuously wound onto a core taking care to see that the channels of the consecutive layers were precisely aligned in relation to each other in order to ensure the passage of the flow of medium therebetween. However such a structure could only be produced by a machine moving in steps and with a high degree of accuracy. If the required degree of precision was not kept to while winding the strip on the core the resulting structure would interfere with the flow of the medium.

SHORT SUMMARY OF THE PRESENT INVENTION

One object of the present invention is to provide for a further simplification of the production of such a rotor.

A further aim of the invention is to accelerate the production process while at the same time ensuring an evenly proceeding thermal transfer at a particularly high rate.

In order to achieve these or other objects appearing from the present specification and claims, a further strip is provided on the rotor which is free of channels and is also wound on the permeable core helically so as to be associated with the channeled strip so that the layers or turns of the unchanneled strip alternate with those of the channeled one with each layer or turn of the channeled strip being followed by one layer or turn of the unchanneled one. In this respect the arrangement may for instance be such that the consecutive layers of the two strips are arranged parallel or approximately so in relation to each other. It is an advantage if the channeled strip has a corrugated or zig-zag form with an amplitude of the corrugations therein equal to between 1 and 5 mm and preferably to approximately 2 mm, while the channel to channel pitch may be between 2 and 8 mm and more especially amounts to approximately 5 mm. On the other hand the layers of the unchanneled strip may be comprised in a single plane. It is convenient if the unchanneled strip has axial holes therein for the passage of the medium. In this respect the unchanneled strip may have a structure resembling that of expanded metal lathing, while the channels of the channeled strip extend in a radial direction from the outside to the inside, that is to say towards the longitudinal center axis of the core with a taper so that the strip is compacted at the radially inner side thereof.

The arrangement in accordance with the invention involves two advantages, namely that the thermal efficiency and the flow efficiency are extraordinarily high and that this advantage is combined with a further simplification and cheapening of the production process. The thermal efficiency is improved because of the fact that it is now possible to utilize the thinnest possible sheet metal for the two strips and to have a very fine corrugated channeling of the channeled strip, there a very large surface area available for the heat exchanger. It is possible to see further advantages in the fact that the flow through the rotor will be practically completely smooth or free of turbulence while production is simple. More especially, a satisfactory continuous method of production may be employed without absolute accuracy on fitting the consecutive layers together being of primary importance. In this respect the unchanneled strip serves to more or less direct the flow and to avoid turbulence and other irregularities in the flow, although owing to the small amplitude or height of the channels it is now no longer significant whether the consecutive layers are in communication with each other to some extent or not. Furthermore, if the heat exchanger is used for clean air, the channels may be small or very small while the medium with which the heat exchanger is used is contaminated, it is preferred to provide large channels.

Production may for instance be further simplified if the channels in the channeled strip are produced with the aid of cooperating conical embossing rolls which in the embossing station are in engagement with each other and run against each other so that the strip to be channeled, as for instance aluminum sheet strip, may be drawn through the nip between the rolls continuously, while the plain or unchanneled strip may be slotted by, for instance, stamping, and being subjected to tension in the length direction of the strip so that the slots assume a rhombic form. The primary purpose of the slots is to prepare and adapt the unchanneled strip so that it may be readily wound about the core. However apart for the provision of slots, this aim may be achieved in some different way, for instance by using rolls to extend the strip at its upper radially outer edge while in at the lower, inner edge the strip is compressed. It is preferred to produce the channeled and the unchanneled strips in separate stations so as to be ready for winding and then to wind them onto the core continuously which is placed on a mandril rotating about an axis perpendicular to the axis of rotation of the embossing roll, the core then also being moved along the axis of this mandril. It will be clear that production only demands a few simple operations without any additional measures being needed to achieve an excessive degree of accuracy.

The invention will now be described in more detail with reference to the accompanying drawings.

LIST OF THE SEVERAL VIEWS OF THE DRAWINGS

FIG. 1 shows a rotor in accordance with the present invention as part of a regenerative heat exchanger in a perspective, diagrammatic overall view.

FIG. 2*a* shows a part of a rotor as in FIG. 1 in a side view which is again diagrammatic.

FIG. 2*b* shows a detail of the arrangement of FIG. 2*a* on a larger scale.

Figure 1:
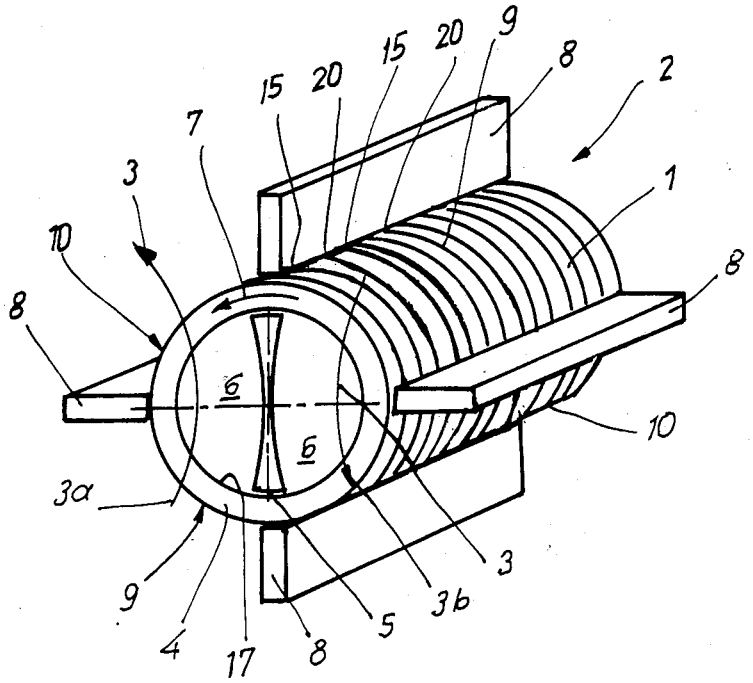
Figure 5A:
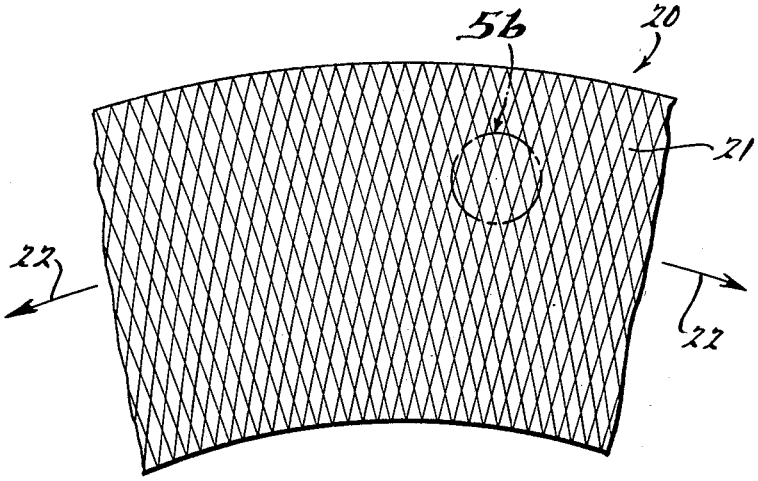

FIG. 5*a* is a partial diagrammatic view looking down on the plain or channel-free strip of a rotor as in FIG. 1.

Figure 5B:
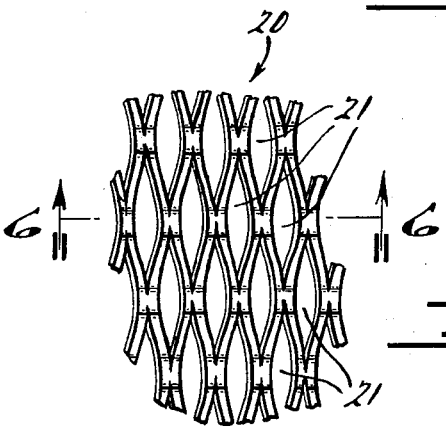

FIG. 5*b* shows a detail of the structure of FIG. 5*a* on a larger scale.

Figure 6:
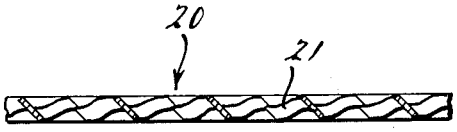

FIG. 6 is a diagrammatic view from the front of the channel-free strip of FIG. 5*a*.

Figure 7:
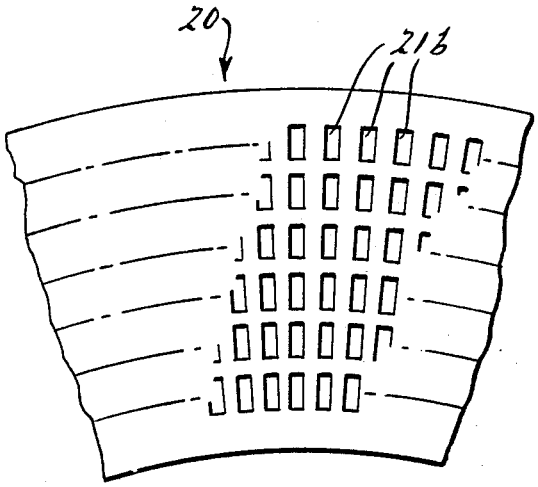
Figure 8:
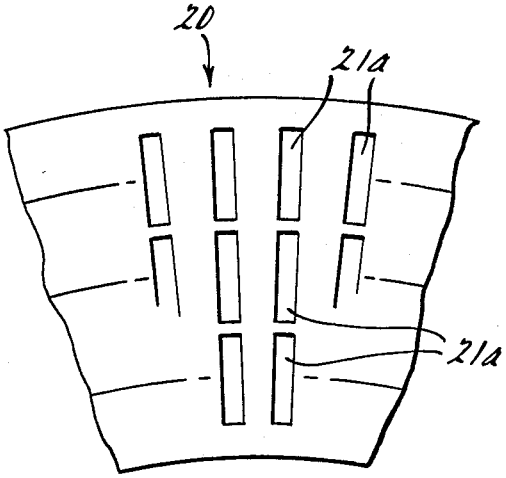

FIG. 7 is a fragmentary partially schematic view looking down on the plane or channeled strip of a rotor with narrow slots;

FIG. 8 is a view similar to FIG. 7 disclosing wide slotted openings in the channel-free strip of the rotor.

DETAILED ACCOUNT OF THE INVENTION

FIG. 1 shows the rotor in accordance with the invention which has been generally referenced 1 and which forms part of a heat exchanger generally referenced 2 and which is shown with part of its housing broken away. Two flows of mediums or fluids move through the rotor 1 in the direction indicated by the arrows 3, each of the two flows of medium passing in a generally radial direction through the casing 4 of the rotor 1. The interior of the rotor 1 is divided up by a partition 5 into two chambers 6, one for each of the two flows. The partition 5 is stationarily arranged in the interior of the rotor 1 and constitutes a part of the housing in which the rotor 1 rotates about its longitudinal axis as marked by the arrow 7. The housing of the heat exchanger 2 further includes partitions 8 which adjoin the outer casing of the rotor 1 and separate the inlet parts 9 and the outlet parts 10 of the two flows from each other. The inlet and outlet parts for the one and the other flow are spaced about the circumference of the rotor 1 by 90° and the inlet and outlet parts for the two flows are opposite to each other on the periphery of the rotor so that the outlet part 10 for the flow 3*a* is diametrally opposite to the outlet part 10 of the flow 3*b* while the inlet part 9 of the flow 3*a* is diametrally opposite to the inlet part 9 for the flow 3*b*. With this arrangement it will thus be seen that the flows pass in opposite directions through the rotor 1, this being an advantage as regards the efficiency of heat exchange. In the inlet part 9 there is a respective flow through the casing 4 from the outside in an inward direction and in the outlet part 10 there is a flow from the inside in an outward direction. Where the rotor has the flows passing through it the rotor 1 is heated, since heat is abstracted from the flow which was hotter in the first place. Owing to the rotation of the rotor 1 in the direction of the arrow 7 the heated part of the rotor 1 is moved into the flow of the other, originally colder flow, which takes up heat here and at the same time cools down the rotor 1. When further rotation takes place the cold part of the rotor casing 4 moves back in the hot flow and the heat transfer operation is accordingly repeated.

The rotor 1 has the configuration of a hollow, circularly cylindrical heat exchanger roller whose casing contains a number of layers of a strip 15 which is placed on edge so as to be radially aligned and which has channels 16 made in it which assure the radial passage of the flow in question as marked by the arrows 3. This strip 15 provided with the channels 16 is helically wound on a core 17 which is permeable for the flows, i.e. it allows the flows to move through it. The core may be in the form of a perforated metal cylinder with a large free cross sectional area or it may be in the form of a piece of piping with openings through its wall. The core 17 thus serves as a support for the coils of the strip 15 and thus as a carrying support of the rotor 1 in the housing of the heat exchanger 2 while its internal surface simultaneously serves as a smooth running surface for the partition 5 so that the latter may be placed with a very small clearance between it and the internal casing surface of the core 17. The core 17 may also be made of a stiff wire fabric but a cage structure of the core 17 would also be possible in the case of which there would be a large number of bars arranged parallel to each other on the outer surface of the cylinder, such bars then being supported relatively at their ends. The openings in the wire fabric or the spaces between the bars would then form the opening or passage for the flows, which move through them with a low degree of resistance. Such a design of the heat exchanger roll or drum has been proposed in the German Pat. No. 3,308,445.

Figure 2A:
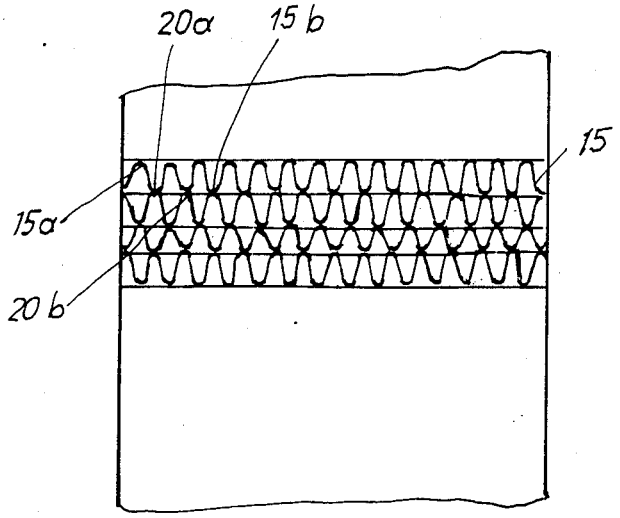
Figure 2B:
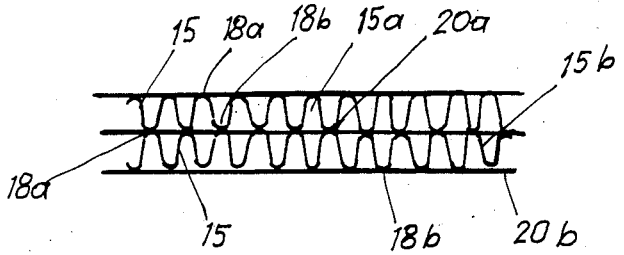

In accordance with the present invention the channeled strip 15 is placed adjacent to a second strip 10 which is also helically wound on the permeable core 17 and which is not channeled. The individual layers or turns of this strip 20 alternate with the layers of the channeled, or more specifically corrugated, strip 15 in such a manner that each layer of the channeled strip 15 is followed by a layer or turn of the unchanneled strip 20 and vice versa. In this design the consecutive layers of the two strips 15 and 20 are placed so as to be parallel, or approximately so, to each other. This arrangement is shown in detail in FIGS. 2*a* and 2*b*, from which it will be seen that the layer or turn 15*a* of the channeled strip is followed by the layer 20*a* thereunder of the unchanneled strip 20, which is then followed by the layer 15*b* of the channeled strip 15 which rests on the layer 20*b* of the unchanneled strip 20. It is best for the alternating layers ot be in contact with each other. The primary purpose of the layers of the unchanneled strip is to direct and guide the flow of the medium serving for heat exchange without fitting the individual layers exactly together.

Figure 3:
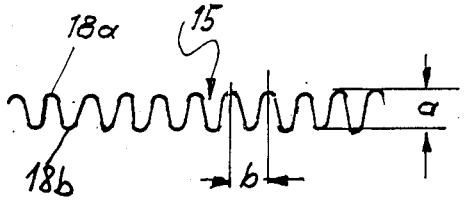
FIG. 3 shows channeled strip of a rotor as in FIGS. 1 and 2 from the front in a diagrammatic view of part of the structure.
Figure 4:
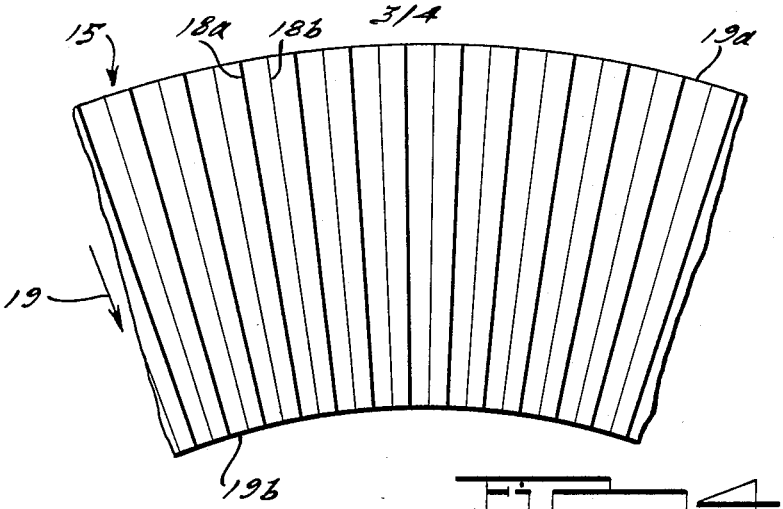
FIG. 4 is a further diagrammatic view looking down on the arrangement of FIG. 3.

As will be more especially seen from FIGS. 3 and 4, the channeled strip 15 has a corrugated or zig-zag structure, and it will be especially be apparent from FIG. 3 that there are waves 18*a* and troughs 18*b* coming thereafter which rest on the unchanneled strip. The height a of the corrugated structure is between 1 and 5 mm and preferably amounts to approximately 2 mm, while the corrugation pitch b amounts to between 2 and 8 mm, or more especially approximately 5 mm. Lastly it is to be noted that the channeling of the channeled strip 15 tapers radially inwards (see arrow 19 in FIG. 4) from the outside 19*a* to the inside 19*b* towards the longitudinal center axis of the core so that at the radially inner side the strip is compacted or more puckered than at the outer edge. The channels in the channeled strip 15 are produced by cooperating conical embossing rolls whose peripheries are in engagement with each other in the embossing station where they are located. The strip to be furnished with channels, as for example in the form of aluminum sheet is drawn through the nip of the embossing rolls continuously. The corrugations or channels may be made small in size if the heat exchanger is to be used in conjunction with clean air and if the flow is dirty air they will have to be made with a suitably larger size.

As will be seen from the drawing the individual layers of the unchanneled strip 20 are comprised in a plane so that the troughs of the corrugated structure of the channeled strip are well able to engage this flat, even unchanneled strip. The unchanneled strip 20 has axially directed openings 21 so that this unchanneled strip 20 has the form of expanded metal as will be more especially seen from FIG. 5*a* of the drawing. This unchanneled strip, consisting for example of aluminum, is provided with slots by stamping for instance and then stretched by a tensile force acting in the length direction as indicated by the arrows 22 so that the slots assume a rhombic shape. This makes it possible for the strip to be readily wound onto the cylindrical core without any further preparation. Dependent on specific requirements referring now to FIGS. 7 and 8, the slots 21*a* or 21*b* may be placed with a large distance between them (as a wide mesh structure or expanded metal lathing) or quite close to each other respectively.

Owing to the design of the two strips as described it is possible to employ very thin sheet metal for the production of the strips and furthermore the channels may be very small in size so that—owing also to the large heat transfer surface as well—there is a highly satisfactory heat transfer action and there are also advantages as regards the flow since the radial flow through the heat exchanger roller is more or less completely free of any disturbance or turbulence.

The production of the novel heat exchanger roll is simple and low in price. Firstly the channeled and the unchanneled strips are produced in a finished condition at separate stations, that is to say a station for stamping and stretching in the case of the unchanneled strip and channeling by suitable embossing rolls in the case of the channeled strip and the two strips are continuously wound onto the core in the form of helices after the ends of the strips have been anchored to the core. In lieu of a stretched openwork structure, which primarily serves to facilitate winding of the respective strip on the core, the strip may be produced in a helical form by extending the outer edge of the strip by rolling and compressing the inner edge part thereof. The strip may be wound on the core in such a compact array that, as has already been described, the corrugation troughs 18*b* of the channeled strip 15 rest on the plane of the following layer of the unchanneled strip 20 and the layer of this unchanneled strip 20 for its part rest on the waves 18*a* of the corrugated structure of the following layer of the channeled strip.

In this respect it is possible for the ends of the core to have covers which extend past the outer surface of the core and contain the strips between them, the strips best being clamped between the covers and being wound compactly between the same so that they are retained by their inherent elasticity.

I claim:

1. A regenerative heat exchanger rotor with an outer casing which comprises:

a plurality of layers of a helically wound strip orientated so that its width direction is radial with respect to the rotor;

a core on which the strip is wound and which is permeable for the medium with which the rotor is to be used;

said strip having channels therein to allow the radial passage of the current of the medium;

a second strip on the rotor being free of channels and being also wound on the permeable core helically so as to be associated with the channeled strip so that the layers or turns of the unchanneled strip alternate with those of the channeled one with each layer or turn of the channeled strip being followed by one layer or turn of the unchanneled one;

the individual layers of the unchanneled strip being respectively comprised in a single plane; and the unchanneled strip having axially extending openings therein.

2. A regenerative heat exchanger rotor with an outer casing which comprises:

a plurality of layers of a helically wound strip orientated so that its width direction is radial with respect to the rotor;

a core on which the strip is wound and which is permeable for the medium with which the rotor is to be used;

said strip having channels therein to allow the radial passage of the current of the medium;

a second strip on the rotor being free of channels and being also wound on the permeable core helically so as to be associated with the channeled strip so that the layers or turns of the unchanneled strip alternate with those of the channeled one with each layer or turn of the channeled strip being followed by one layer or turn of the unchanneled one;

the individual layers of the unchanneled strip being respectively comprised in a single plane; and the unchanneled strip having the form of expanded metal.

3. A regenerative heat exchanger rotor with an outer casing which comprises:

a plurality of layers of a helically wound strip orientated so that its width direction is radial with respect to the rotor;

a core on which the strip is wound and which is permeable for the medium with which the rotor is to be used;

said strip having channels therein to allow the radial passage of the current of the medium;

a second strip on the rotor being free of channels and being also wound on the permeable core helically so as to be associated with the channeled strip so that the layers or turns of the unchanneled strip alternate with those of the channeled one with each layer or turn of the channeled strip being followed by one layer or turn of the unchanneled one;

the individual layers of the unchanneled strip being respectively comprised in a single plane; and the unchanneled strip having widely spaced slots with a relatively large width therein.

4. A regenerative heat exchanger rotor with an outer casing which comprises:

a plurality of layers of a helically wound strip orientated so that its width direction is radial with respect to the rotor;

a core on which the strip is wound and which is permeable for the medium with which the rotor is to be used;

said strip having channels therein to allow the radial passage of the current of the medium;

a second strip on the rotor being free of channels and being also wound on the permeable core helically so as to be associated with the channeled strip so that the layers or turns of the unchanneled strip alternate with those of the channeled one with each layer or turn of the channeled strip being followed by one layer or turn of the unchanneled one;

the individual layers of the unchanneled strip being respectively comprised in a single plane; and the unchanneled strip having closely spaced narrow slots therein.

5. A regenerative heat exchanger rotor with an outer casing which comprises:

a plurality of layers of a helically wound strip orientated so that its width direction is radial with respect to the rotor;

a core on which the strip is wound and which is permeable for the medium with which the rotor is to be used;

said strip having channels therein to allow the radial passage of the current of the medium;

a second strip on the rotor being free of channels and being also wound on the permeable core helically so as to be associated with the channeled strip so that the layers or turns of the unchanneled strip alternate with those of the channeled one with each layer or turn of the channeled strip being followed by one layer or turn of the unchanneled one;

the individual layers of the unchanneled strip being respectively comprised in a single plane; and the unchanneled strip having axially extending openings therein and consisting of aluminum.

6. A regenerative heat exchanger rotor with an outer casing which comprises:

a plurality of layers of a helically wound strip orientated so that its width direction is radial with respect to the rotor;

a core on which the strip is wound and which is permeable for the medium with which the rotor is to be used;

said strip having channels therein to allow the radial passage of the current of the medium;

a second strip on the rotor being free of channels and being also wound on the permeable core helically so as to be associated with the channeled strip so that the layers or turns of the unchanneled strip alternate with those of the channeled one with each layer or turn of the channeled strip being followed by one layer or turn of the unchanneled one;

the unchanneled strip being provided with slots and being stretched by a tensile force acting in the length direction so that the slots are caused to take on a rhombic form forming rhombic axially extending apertures.

7. A regenerative heat exchanger rotor with an outer casing which comprises:

a plurality of layers of a helically wound strip orientated so that its width direction is radial with respect to the rotor;

a core on which the strip is wound and which is permeable for the medium with which the rotor is to be used;

said strip having channels therein to allow the radial passage of the current of the medium;

a second strip on the rotor being free of channels and being also wound on the permeable core helically so as to be associated with the channeled strip so that the layers or turns of the unchanneled strip alternate with those of the channeled one with each layer or turn of the channeled strip being followed by one layer or turn of the unchanneled one;

the channeled strip having a corrugated or zigzag structure;

the amplitude of the channels being equal to approximately 2 mm and the channel to channel pitch amounts to approximately 5 mm;

the strips being made of aluminum sheet; and the unchanneled strip having slots produced in it by stamping.

* * * * *